US010407289B2

(12) United States Patent
Bondi et al.

(10) Patent No.: US 10,407,289 B2
(45) Date of Patent: Sep. 10, 2019

(54) MACHINE FOR FILLING BOTTLES, CANS AND LIKE CONTAINERS

(71) Applicant: 764944 ALBERTA INC., Calgary (CA)

(72) Inventors: Robert Donald Bondi, Calgary (CA); Allan Joseph Merlo, Calgary (CA); John Joseph Bedek, Talbotville (CA)

( * ) Notice: Subject to any disclaimer, the term of this patent is extended or adjusted under 35 U.S.C. 154(b) by 383 days.

(21) Appl. No.: 15/372,784

(22) Filed: Dec. 8, 2016

(65) Prior Publication Data

US 2017/0158482 A1 Jun. 8, 2017

Related U.S. Application Data

(60) Provisional application No. 62/264,383, filed on Dec. 8, 2015.

(51) Int. Cl.

| | |
|---|---|
| ***B67C 3/26*** | (2006.01) |
| ***B67C 3/24*** | (2006.01) |
| ***B67C 3/28*** | (2006.01) |

(52) U.S. Cl.

CPC ..... *B67C 3/26* (2013.01); *B67C 3/24* (2013.01); *B67C 3/28* (2013.01)

(58) Field of Classification Search

CPC ..... B67C 3/26; B67C 3/28; B67C 3/24

See application file for complete search history.

(56) References Cited

U.S. PATENT DOCUMENTS

| | | | |
|---|---|---|---|
| 2,215,702 | A | 2/1939 | Holm |
| 2,713,874 | A | 6/1950 | Sundstrom |
| 3,050,091 | A | 8/1962 | Meyer |

(Continued)

FOREIGN PATENT DOCUMENTS

| | | | |
|---|---|---|---|
| CN | 203715233 | U | 7/2014 |
| CN | 104418268 | A | 3/2015 |

(Continued)

*Primary Examiner* — Timothy P. Kelly

(74) *Attorney, Agent, or Firm* — Field LLP

(57) ABSTRACT

A container filling machine is provided having one or more filling units. The filling units have a valve actuator assembly having a first end moveably connected to the filling machine to effect both lateral movement and reciprocating longitudinal movement; and a valve connected to a second end of the valve actuator assembly, such that longitudinal movement of the valve actuator assembly actuates the valve to open and fill a container. The filling machine has alternating filling units each comprising a different valve dedicated for a particular variety of container. A method is also taught for filling one or more types of containers with a liquid. The method includes the steps of feeding a stream of alternating types of containers to a filling machine, said filling machine comprising one or more travelling filling units, each filling unit comprising a valve actuator, and a valve; associating each of said alternating types of containers with a filling unit wherein said valve is dedicated for a particular variety of container; actuating said valve actuator as it travels along the filling machine to actuate said valve; actuating said valve to fill said associated container; and disengaging each of said alternating types of containers from said filling unit. A container filling unit adapted for filling one or more types of containers is further taught.

10 Claims, 7 Drawing Sheets

(56) References Cited

U.S. PATENT DOCUMENTS

| | | | | |
|---|---|---|---|---|
| 3,455,350 | A | 7/1969 | Hinxlage Aloys | |
| 3,537,231 | A | 11/1970 | Dimond | |
| 4,099,361 | A | 7/1978 | Dix et al. | |
| 4,442,653 | A | 4/1984 | Rademacher | |
| 5,440,494 | A | 8/1995 | Akamaru | |
| 5,469,899 | A | 11/1995 | Nish | |
| 7,287,562 | B2 * | 10/2007 | Tanikawa ..... | B67C 3/2614 141/367 |
| 2007/0107801 | A1 | 5/2007 | Cochran et al. | |
| 2008/0236215 | A1 | 10/2008 | Jenne | |
| 2017/0001848 | A1 | 1/2017 | DiCarlo et al. | |

FOREIGN PATENT DOCUMENTS

| | | | |
|---|---|---|---|
| DE | 1085784 | | 7/1960 |
| DE | 1164866 | | 3/1964 |
| DE | 1283112 | | 6/1965 |
| DE | 1236363 | | 3/1967 |
| DE | 7012174 | | 4/1970 |
| DE | 4026093 | A1 | 8/1990 |
| EP | 0572107 | A1 | 12/1993 |
| WO | 199424037 | A1 | 10/1994 |

* cited by examiner

MACHINE FOR FILLING BOTTLES, CANS AND LIKE CONTAINERS

FIELD OF THE INVENTION

The present invention relates to rotary filling machines and in-line filling machines for filling bottles and cans with liquids.

BACKGROUND OF THE INVENTION

Filling machines are commonly used in industrial bottling and canning plants for filling containers with liquids such as beverages, including wine, beer, mineral water, etc. Most commonly, each filling machine allows for filling of only one type of container.

Filling machines have traditionally come in two types:

1) Rotary filling machines with a rotating carousel/bowl having mounted along its periphery, a plurality of filling valves which are able to convey the liquid contained in a cylindrical tank or filler bowl into the bottle or can. These rotary filling machines are typically operational midstream in a bottling or canning line and provides separate dedicated filling of bottles or cans 2) Inline filling machines where containers are filled from one or more manifolds having valves mounted along their length. Containers move through the machine in a linear fashion. Inline filling machines typically operate with separate dedicated filling of either bottles or of cans on a single manifold for each container type.

Both rotary and inline filling machines take up a significant footprint, or floorspace in the bottling or canning facility. While sizes of can or bottle filling machines vary, typical these machines require about 100 square feet of area for operation. The typical volume of such filling machines varies somewhat with type. Inline filling machines are somewhat slower with less capacity, having between 2 to 6 valves per manifold and typically filling about 20 to 60 bottles/minute or about 20 to 60 cans/minute. Typical rotary filling machines have a capacity of about 50-250 bottles or cans per minute for small to medium sized operations.

In all existing examples of any of the above rotary filling or inline machines the current state of the art is to have a machine that has been designed, built and setup specifically to fill either bottles or cans. Current day state of the art liquid filling machines are dedicated in nature without the ability to fill both bottles and cans on one machine with one carousel/bowl or with one manifold.

In recent years, there has been exponential growth in micro-manufacturers in the beverage industry, and particularly in the growth of micro-brewing of beer across North America and Europe. Micro-brewing involves small batch brewing and packaging of beverages to smaller, often local but not always, markets. Micro-manufacturers of beverages often change the product that they manufacture from batch to batch and work in small facilities with a goal of versatility.

The present day state of the art bottle filling machines and can filling machines, be they rotary or inline, are simply too large for micro-manufacturers. Moreover, should a micro-manufacturer wish to package their beverages in both bottles and cans, they will be required to house both types of filling machines, requiring facilities with much larger floor space than their operations and output justify and going against a goal of minimizing space.

A need therefore exists in the art for bottle and can filling machines that take up a smaller footprint and provide versatility in container to be filled.

SUMMARY

A container filling machine is provided comprising one or more filling units. The filling units comprises a valve actuator assembly having a first end moveably connected to the filling machine to effect both lateral movement and reciprocating longitudinal movement; and a valve connected to a second end of the valve actuator assembly, such that longitudinal movement of the valve actuator assembly actuates the valve to open and fill a container. The filling machine has alternating filling units each comprising a different valve dedicated for a particular variety of container.

SUMMARY

A container filling machine is taught, said machine comprising one or more filling units, said filling units comprising a valve actuator assembly having a first end moveably connected to the filling machine to effect both lateral movement and reciprocating longitudinal movement; and a valve removably connected to a second end of the valve actuator assembly, such that longitudinal movement of the valve actuator assembly actuates the valve to open and filler a container, wherein the valve is adapted to fill a plurality of varieties of containers.

A method is also taught for filling one or more types of containers with a liquid. The method comprises feeding a stream of alternating types of containers to a filling machine, said filling machine comprising one or more travelling filling units, each filling unit comprising a valve actuator, and a valve; associating each of said alternating types of containers with a filling unit wherein said valve is dedicated for a particular variety of container; actuating said valve actuator as it travels along the filling machine to actuate said valve; actuating said valve to fill said associated container; and disengaging each of said alternating types of containers from said filling unit.

A container filling unit adapted for filling one or more types of containers is further taught, said container filling unit comprising a valve actuator assembly, and a valve removably connected to the valve actuator assembly, such that longitudinal movement of the valve actuator assembly actuates the valve to open and fill a container.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

Figure 1:
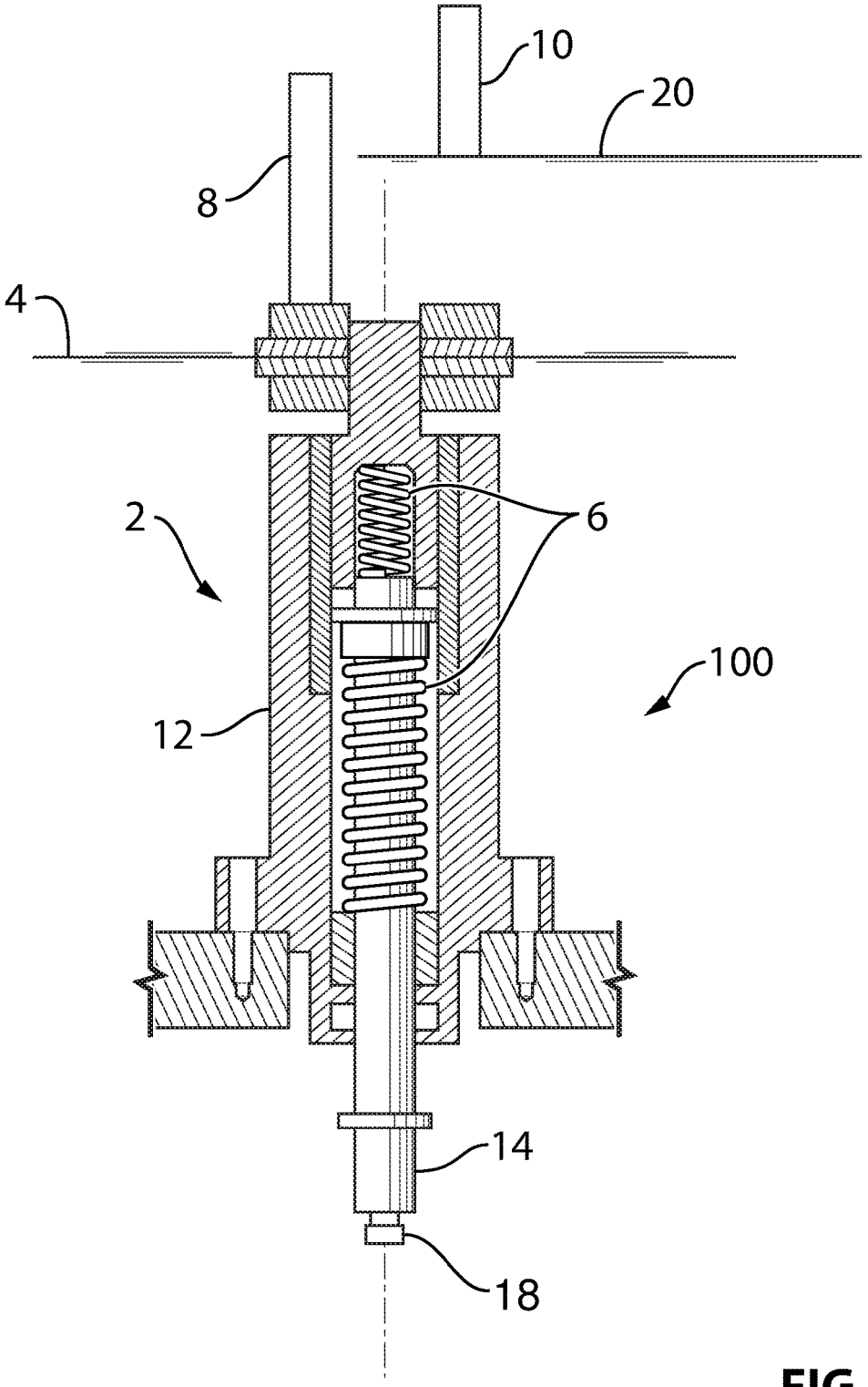
FIG. 1 PRIOR ART
FIG. 1 is a cross sectional elevation view of a filler unit for a beverage container filling machine, comprising a top mounted actuator assembly.

The drawing is not necessarily to scale and in some instances proportions may have been exaggerated in order more clearly to depict certain features.

DISCLOSURE OF THE INVENTION

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present invention relates to filling machines, filler valves and filling methods adapted for filling any number of types of containers. More preferably the present invention relates to filling machines, valves and methods adapted for filling both bottles and cans. Further preferably, the present invention relates to filling machines in the beverage industry and more particular breweries. It would however be understood by a person of skill in the art that any number of types and sizes of containers, including but not limited to bottles and cans of any material and size, cartons, jugs, tetrahedral packaging such as Tetra-Pack™ containers, and others. It would also be understood by a person of skill in the art that while beverage filling is discussed more particularly in the description below, the present innovations are equally applicable to the filling of other liquids such as paints, fuels, liquid chemicals, liquid foodstuffs or ingredients, among many others.

The present filling machine can be optionally adapted to fill batches of cans or batches bottles, or the machine can be adapted for filling a mix of bottles and cans as they run through the machine in a predetermined order. Preferably, the present filling matching is selected from one of either a single manifold in-line filling machine or a single carousel/bowl rotary filing machine. More preferably the present filling machine is a rotary filling machine. The present filling machine serves to overcome the dedicated nature of bottle and can filling machines.

FIG. 1 shows a filling unit 100 of the present invention comprising a top mounted valve actuator assembly 2, mounted to and extending downwardly from either a linear moving inline manifold or to the rotating carousel/bowl 4. The valve actuator assembly 2 is biased upwards by means of one or more actuator shaft springs 6. A lower attaching head 14, is connectable to a filler valve 18.

As the valve actuator assembly 2 travels along the direction of movement (linear or rotational) an upwardly protruding upper cam surface 8 of the actuator shaft contacts a fixed cam 10 that is attached to a bridal (not shown) and is fixed to non-rotating filler platform 20, thereby urging the valve actuator shaft 12 down. Lowering of the actuator shaft serves actuate the filler valve 18 to enter the mouth of bottle or can to be filed and to open to allow flow of the beverage into the container, which is travelling with the filler unit 100.

Typical filling machines are dedicated based on the container to be filled. As such filling machines for bottles differ from those for cans. As previously discussed, the prior art goal has been to maximize filling volume for a specific type of container and produce as great an output as speedily as possible.

The present inventors have noted that by adapting the filling valve 18 of each filler unit 100, filling machines can be customized to fill variety of containers using a singular machine. In doing so, it enables facilities such as micro-manufacturers to purchase, house and operate a single machine for a variety of container filling purposes.

In a first embodiment, the filler valve 18 can be a singular valve adapted to fill both bottles and cans. In this embodiment a filling machine can be set up with a singular valve at each filler unit 100 and the machine can be operated with an alternating order of bottles and cans In a second more preferred embodiment, dedicated can-filling and bottle-filling units 100 are used in alternating pattern on the filling machine.

Figure 6:
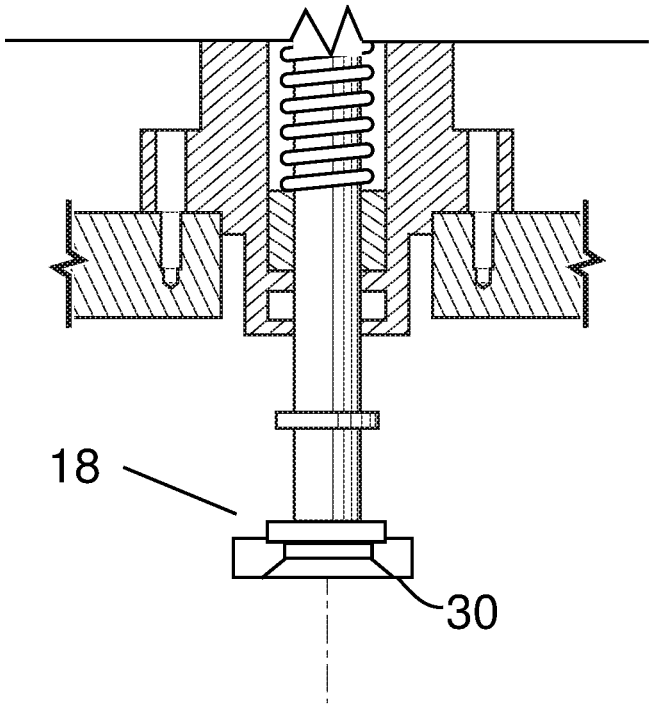
FIG. 6 is a cross-sectional elevation of one example of a filler valve of the present invention.

With reference to FIG. 6, filler valves 18 of a first embodiment of the present invention are shown. While the upper end of the present filler valve is similar for all types of container, the lower end of the present filler valve 18, also called the bell 30, is advantageously, preferably adapted to suit a particular type of container, for example only, either a bottle or can.

Figure 2:
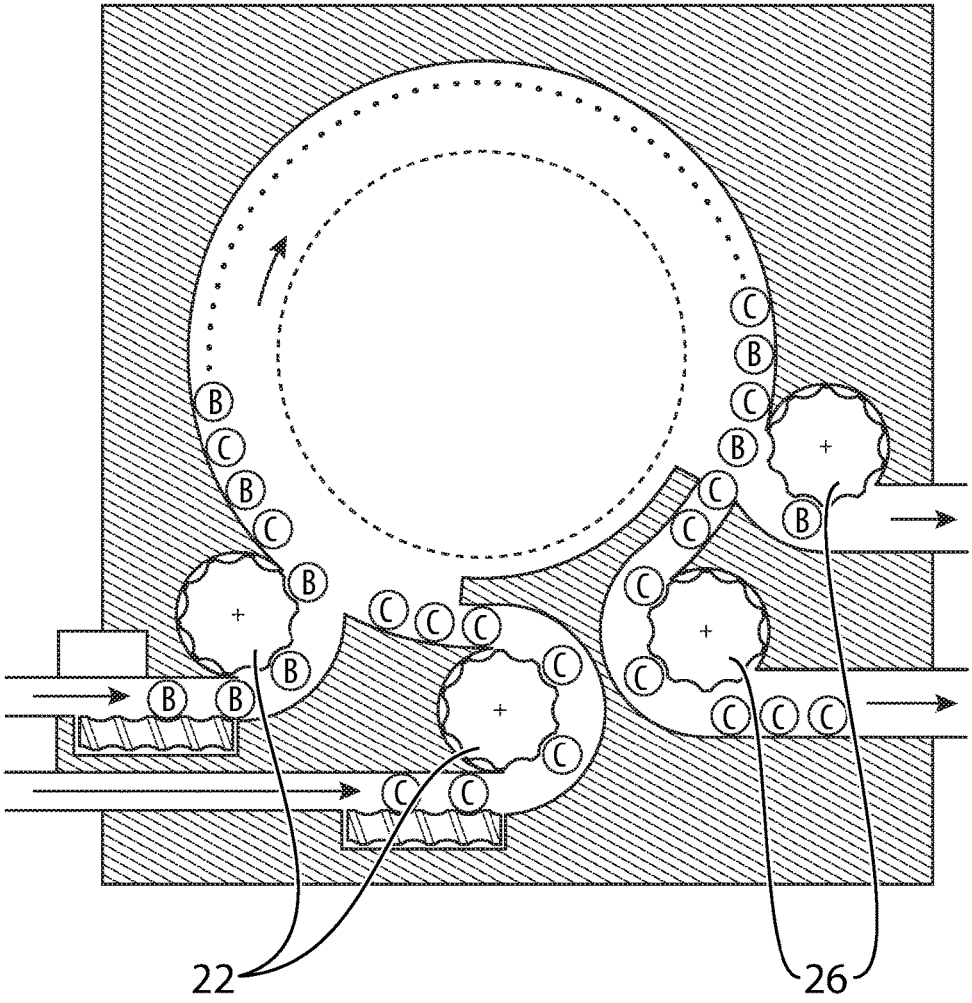
FIG. 2 is a first example of a rotary filling machine of the present invention.
Figure 3:
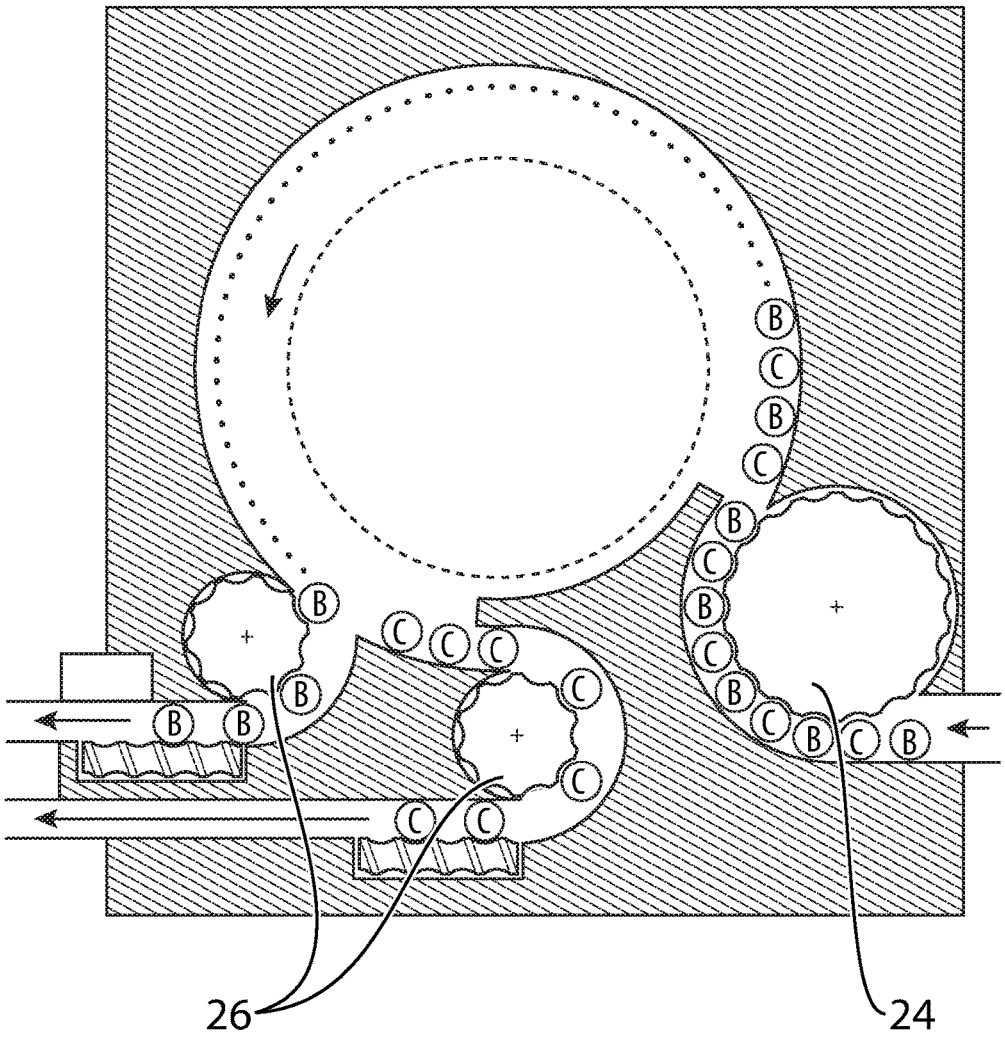
FIG. 3 is a second example of a rotary filling machine of the present invention.
Figure 4:
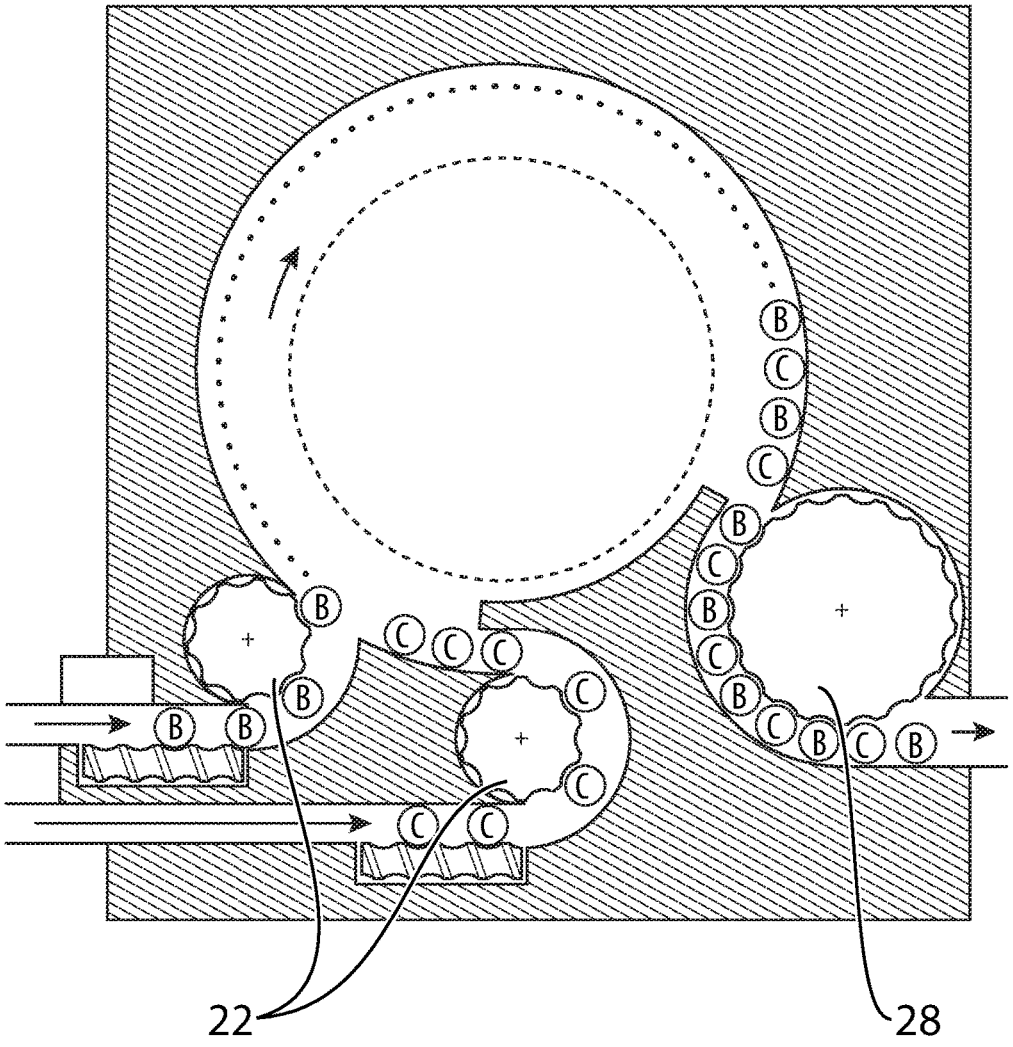
FIG. 4 is a third example of a rotary filling machine of the present invention.
Figure 5:
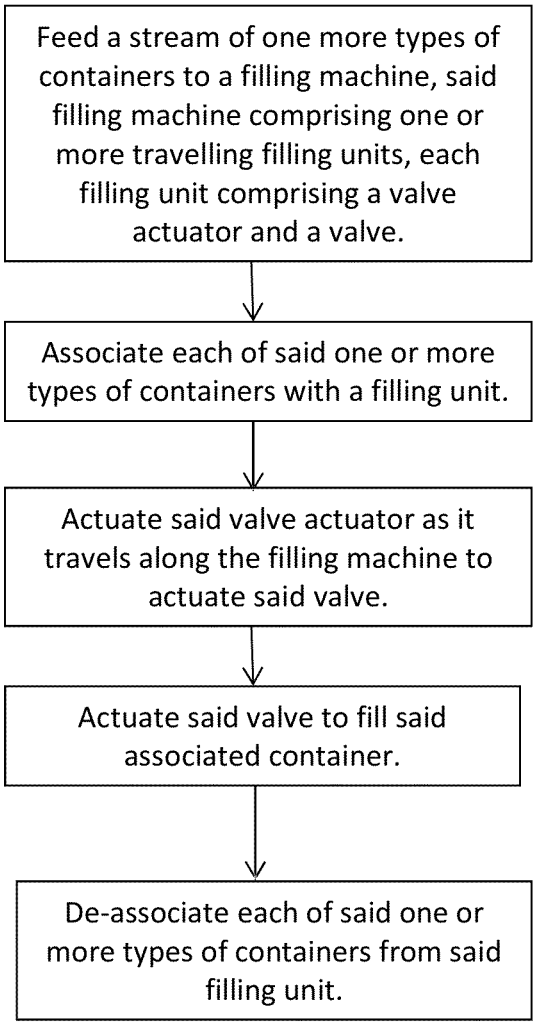
FIG. 5 is a schematic diagram of one embodiment of a method of the present invention.

With reference to FIGS. 2 to 4, in the case of a rotary filling machine embodiment of the present invention, the carousel/bowl comprises one or more filling units 100 with dedicated valves 18 for each type of container, arranged in a predetermined order. More preferably the filler valves 18 are arranged in alternating fashion, such that a bottle, then a can, then a bottle, etc., may be filled alternately. In another embodiment, a rotary filling machine may comprise one or more single filler valve 18 types that are capable of filling both bottles and cans or like containers at every filler unit 100 location.

In a rotary filling machine embodiment of the present invention, a mixed line of bottles and cans enter the carousel/bowl via a single or dual starwheel, indexing mechanism, conveyor or like device. More preferably, the mixed line will be an alternating line of a bottle, then a can, then a bottle, etc.

FIGS. 2 and 4 illustrate dual starwheel infeed 22 and FIG. 3 illustrate a single starwheel infeed 24. In the embodiment of FIGS. 2 and 4, the dual starwheel infeed 22 is more preferably arranged such that a first of the dual starwheel infeeds feeds one type of container and the second of the dual starwheel infeeds feed another type of container.

Once filled, the bottles and/or cans are then preferably directed by a starwheel, indexing mechanism, conveyor or like device to exit the filling machine. FIGS. 2 and 3 illustrate dual starwheel outfeeds 26 and FIG. 4 illustrates a single outfeed 28. More preferably, in the embodiment of FIGS. 2 and 3, a first of the dual starwheel outfeeds receives one container type and a second of the dual starwheel outfeeds receives the other container type. In this preferred embodiment, the rotary filling machine may in one option be adapted to send a particular container type to a particular starwheel outfeed, or alternatively, the outfeed starwheels are adapted to only receive one type of container?

The bottles and cans can then be delivered to respective machines for closure application, with sorting of the containers for dedicated closure machines being conducted downstream, For example closure applications can include crimp crown, roll on pilfer proof (ROPP), cork, cap, plastic cap, can lid/top etc. Containers are then delivered down line for the next step in the packaging process (labeling, cartoning etc.).

It should be note that in a rotary filling machine embodiment of the present invention, it is also possible to fill only one type of container at a time. In such cases, in the dual starwheel infeed embodiment of FIGS. 2 and 4 only one starwheel infeed is loaded with the desired container type. In the embodiment of FIG. 3, it is possible to arrange the single desired container type on the single starwheel infeed in a pattern to match pattern of the dedicated filler valves 18 matching that container type. For example, if dedicated bottle and can filler valves 18 are in alternate order on the filling machine, a stream of only bottles or only cans can be arranged in every alternate space on the single starwheel infeed. Used in this manner, micro-manufacturers are able to fill a single batch of one type of containers at one time and a single batch of a second type of containers at another time, without the need for separate filling machines.

In the case of an in-line filling machine embodiment of the present invention, the inline machine manifold(s) comprise one or more filler units 100 having filler valves 18 that are adapted for either bottles or cans. For example the bottles and cans can be arranged in alternating fashion, although any predetermined arrangement is possible. More preferably, the filling machine may comprise one or more single valve types capable of filling both bottles and cans or like containers at every valve location. However it is also possible that an inline filling machine could also have one or more different valve for different containers arranged in a pattern.

Figure 7:
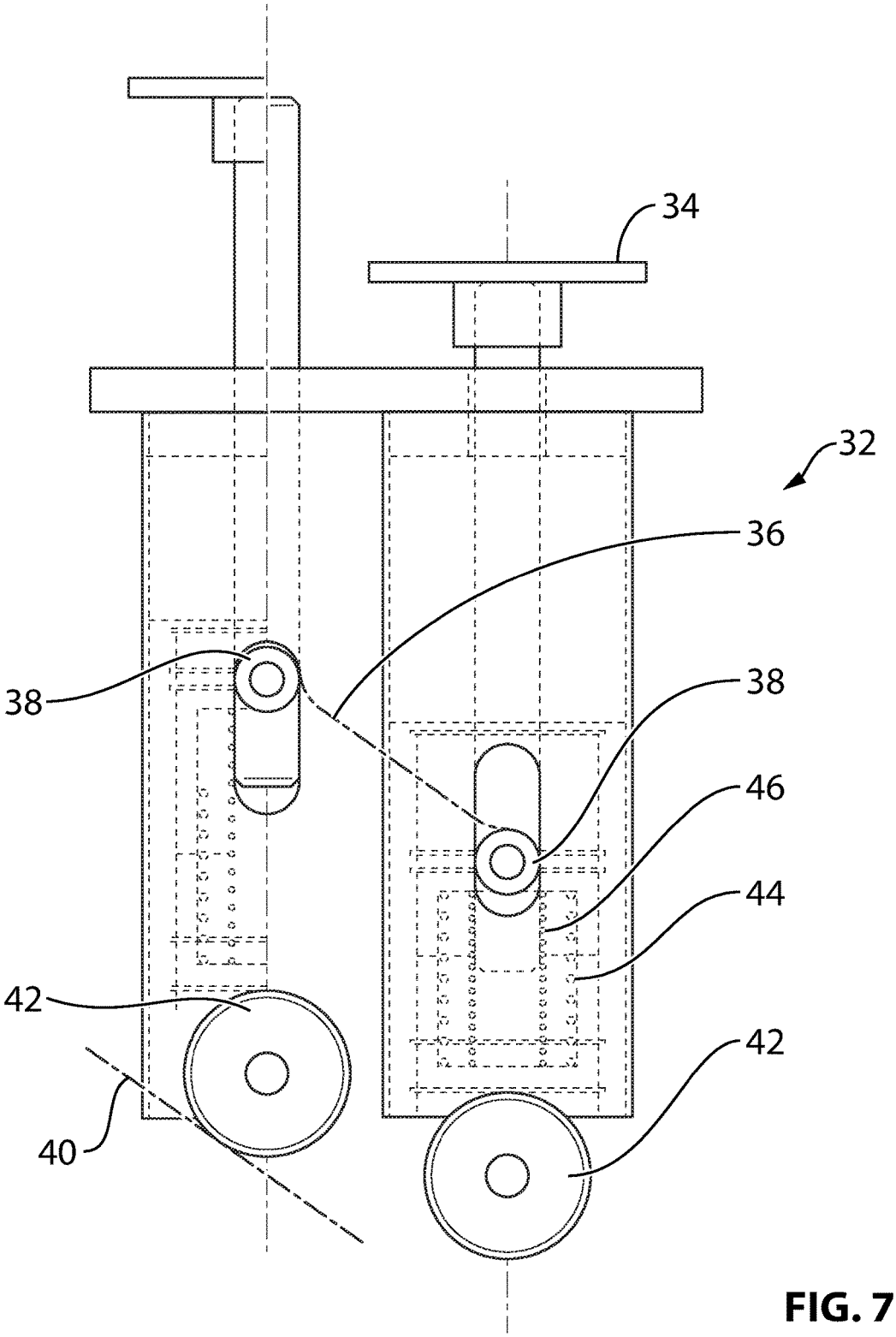
FIG. 7 is a cross-sectional elevation view of one example of a container lift cylinder assembly of the present invention.

With reference to FIG. 7, a container lift cylinder assembly 32 for use with the present filler unit is shown. The cylinder lift assembly 32 is comprised of a container platform 34 upon which the container to be filled is supported, an upper cam surface 36, a plurality of upper cam followers 38, a lower cam surface 40 and a plurality of lower cam followers 42 and outer spring 44 and an inner spring 46.

Movement of the lift cylinder assembly 32 is directed by the outer spring 44 and inner spring 46 that are each controlled independently by the upper cam unit 36/38 and lower cam unit 40/42 creating a progressive rise rate to establish an initial soft seal against the filler unit 100 and then a final pressure tight seal for filling purposes. As the filler assembly moves, the upper cam surface 36 along with the platform 34 rises along cam followers 38, the inner spring 46 rises, then the container platform 34 rises to create the initial soft seal against the filler unit 100. Next the platform 34 begins to rise, guided by lower cam followers 42 travelling on the lower cam 40, and sliding bushing begins to rise and then the, raising outer spring 44 to create the final pressure tight seal.

The differential rates of speed of travel between the upper cam unit 36/38 and lower cam unit 40/42 allow for a soft initial seal of the container to the filler valve 18 by the upper cam and inner spring 46. Pressure tight sealing is achieved last increment of lower cam rise and outer spring 44 compression.

The present cylinder lift assembly 32 is advantageously a non-pneumatic system, depending only on cam and spring actuation for movement. Pneumatic lift systems require pneumatic lines run through the rotary joint of rotary unity and through moving parts of the inline system to the cylinder lift system. Entanglement of lines is not uncommon and means and mechanisms must be put in place to avoid tangling or damage to the pneumatic lines to ensure no pressure loss. A compressed air source is also required at the facility to operate such pneumatic systems. The present non-pneumatic system eliminates the requirement for pneumatic lines or compressed air sources, thereby again reducing the amount of equipment needed for micro-manufacturers to operate.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 U.S.C. 112, sixth paragraph, unless the element is expressly recited using the phrase "means for" or "step for".

The invention claimed is:

1. A container filling machine comprising alternating filling units, each of said filling units comprising:

a. a valve actuator assembly having a first end moveably connected to the filling machine to effect both lateral movement and reciprocating longitudinal movement of the valve actuator assembly relative to the filling machine; and b. a valve connected to a second end of the valve actuator assembly, such that longitudinal movement of the valve actuator assembly actuates the valve to open and fill a container, wherein the alternating filling units each comprise a different valve dedicated for a particular variety of container.

2. The container filling machine of claim 1, wherein the filling machine is selected from a rotary filling machine or an inline filling machine.

3. The container filling machine of claim 1, further comprising a non-pneumatic cylinder lift assembly.

4. A method for filling containers with a liquid, said method comprising:

a. feeding a stream of alternating types of containers to a filling machine, said filling machine comprising one or more travelling filling units, each filling unit comprising a valve actuator, and a valve;

b. associating each of said alternating types of containers with a valve of a filling unit wherein said valve is dedicated for a particular variety of container;

c. actuating said valve actuator as it travels along the filling machine to actuate said valve;

d. actuating said valve to fill said associated container; and e. disengaging each of said alternating types of containers from said filling unit.

5. The method of claim 4, further comprising receiving said alternating types of containers on one or more starwheel outfeeds.

6. The container filling machine of claim 1 wherein the valve actuator assembly is top mounted and extends downwardly from any one of a linear moving inline manifold and a rotating carousel.

7. The container filling machine of claim 3, wherein the cylinder lift assembly is comprised of:

a. a container platform upon which the container to be filled is supported;

b. an upper cam unit;

c. a lower cam unit;

d. an outer spring connected to and controlled by the lower cam unit; and e. an inner spring connected to and controlled by the upper cam unit;

wherein movement of the lift cylinder assembly is directed by the outer spring controlled independently by the upper cam unit and directed by the inner spring controlled independently by lower cam unit to create a progressive rise rate to establish an initial soft seal against the filler unit and then a final pressure tight seal for filling purposes.

8. The container filling machine of claim 7, wherein the upper cam unit comprises an upper cam surface with a plurality of upper cam followers, and said lower cam unit comprises a lower cam surface with a plurality of lower cam followers.

9. The container filling machine of claim 8, wherein differential rates of speed of travel between the upper cam unit and lower cam unit allow for a soft initial seal of the container to the filler valve by the upper cam and inner spring and then a pressure tight sealing by a last increment of lower cam rise and outer spring compression.

10. The container filling machine of claim 9, wherein as the filler machine moves, the upper cam surface along with the platform rises along upper cam followers, the inner spring rises, then the container platform rises to create the initial soft seal against the filler unit, then the platform continues to rise, guided by lower cam followers travelling on the lower cam surface, raising outer spring to create the final pressure tight seal.

* * * * *